7/9/85 XR 4,528,546

United States Patent [19]

Paoli

[11] Patent Number: 4,528,546

[45] Date of Patent: Jul. 9, 1985

[54] HIGH POWER THICK FILM

[75] Inventor: Mark A. Paoli, San Jose, Calif.

[73] Assignee: National Semiconductor Corporation, Santa Clara, Calif.

[21] Appl. No.: 490,758

[22] Filed: May 2, 1983

[51] Int. Cl.[3] ..... H01C 10/00

[52] U.S. Cl. ..... 338/195; 219/121 LM; 219/543; 338/309; 338/314; 430/315

[58] Field of Search ..... 338/195, 308, 309, 275, 338/314, 329; 219/522, 541, 543, 121 LM; 148/9.5; 430/315; 29/620

[56] References Cited

U.S. PATENT DOCUMENTS

| | | | |
|---|---|---|---|
| 3,370,262 | 2/1968 | Marty et al. | 338/309 |
| 3,824,521 | 7/1974 | Horii et al. | 338/275 |
| 3,947,801 | 3/1976 | Bube | 219/121 LM X |
| 4,201,970 | 5/1980 | Onyshkevych | 338/195 |
| 4,217,570 | 8/1980 | Holmes | 338/308 |
| 4,242,152 | 12/1980 | Stone | 148/9.5 |
| 4,284,970 | 8/1981 | Berrin et al. | 338/195 |
| 4,288,530 | 9/1981 | Bedard et al. | 430/315 |
| 4,288,776 | 9/1981 | Holmes | 338/308 |
| 4,297,670 | 10/1981 | Solow | 338/195 |

OTHER PUBLICATIONS

M. A. Paoli "Product Review Resistor Network", *International Society of Hybrid Microelectronics,* Jun. 1982, pp. 534–538.

*Primary Examiner*—Volodymyr Y. Mayewsky
*Attorney, Agent, or Firm*—Paul J. Winters; Gail W. Woodward; Michael J. Pollock

[57] ABSTRACT

A thick film resistor includes a ceramic substrate 10, a pair of spaced apart electrical connections 30 affixed to the substrate 10, a region of electrically resistive material 21 coated onto the ceramic 10 and not in contact with either of the electrical connections 30, the electrically resistive material adapted to be trimmed 25 and 26 along an edge to thereby lower its resistance, and a pair of spaced apart strips of electrically conductive material 12 and 14 formed on the substrate 10 in electrical contact with the resistive material 21 and extending to a respective one of the pair of connectors 30, the strips 12 and 14 being substantially parallel where in contact with resistive material 21 except at ends of the strips 13 and 15 opposite the location to be trimmed 25. The invention places highest electric field concentrations away from the edge to be trimmed.

6 Claims, 2 Drawing Figures

HIGH POWER THICK FILM

BACKGROUND OF THE INVENTION

1. Field of the Invention

This invention relates to hybrid electronic devices, and in particular to a high power thick film resistor which minimizes electric field density in desired locations.

2. Description of the Prior Art

Resistors and resistive elements fabricated with thick film technology are now well-known, and in widespread use in the electronics industry. Such resistors often take the form of a thick film of resistive material which is screen printed onto an insulating substrate. Spaced apart electrical connections to the resistive material cause the material to function as a resistive element between the electrical connections. After fabrication the part is tested and trimmed to the desired resistance. One known technique for trimming such resistors is to use a laser to vaporize a portion of the resistive material, and thereby force any current flowing through the resistor to flow through the remaining regions, creating a higher resistance.

Conventional thick film resistors have been fabricated with substantially parallel electrodes separated by the resistive element. Thus, when the resistor is trimmed, for example, by a laser machining operation, higher electric fields will be present near the edge being trimmed, often resulting in shorting or breakdown in high voltage operation. Furthermore, conventionally available thick film resistors are well known to suffer from hot spots, resulting from slight variations in the thickness of the thick film coating. In addition, the conventional thick film resistor has resistive material approximately one mil thick, and when trimmed, microcracking around the trim kerf is prevalent.

SUMMARY OF THE INVENTION

This invention provides a high voltage thick film resistor which is able to withstand large voltage transients, has minimal drift, and is resistant to arcing. The resistor is fabricated using a thinner coating of resistive material than prior art resistors, which provides more uniform volume resistivity, decreases the probability of hot spots, and enables trimming the resistor with a lower power laser. Of primary advantage to the thick film resistor of this invention is the feature that the conductive strips contacting the resistive element are disposed slightly closer together in a region away from where the resistive material will be trimmed. In this manner the regions of highest electric field are concentrated away from the kerf of the trim, thereby minimizing opportunities of arcing, shorting, or other problems.

In the preferred embodiment a thick film resistor comprises an insulating substrate; a pair of spaced apart electrical connections affixed to the substrate; a region of electrically resistive material coated onto the substrate and not in contact with either of the pair of spaced apart electrical connections, the region of electrically resistive material adapted to be trimmed along an edge to thereby increase its resistance; a pair of spaced apart strips of electrically conductive material on the substrate, each in electrical contact with the region of electrically resistive material and extending to a respective one of the pair of spaced apart electrical connections, the strips being substantially parallel where in contact with resistive material except at the ends of the strips opposite the edge adapted to be trimmed where the strips are closer together, thereby placing the highest electric field away from the edge adapted to be trimmed.

DETAILED DESCRIPTION OF THE PREFERRED EMBODIMENT

Figure 1:
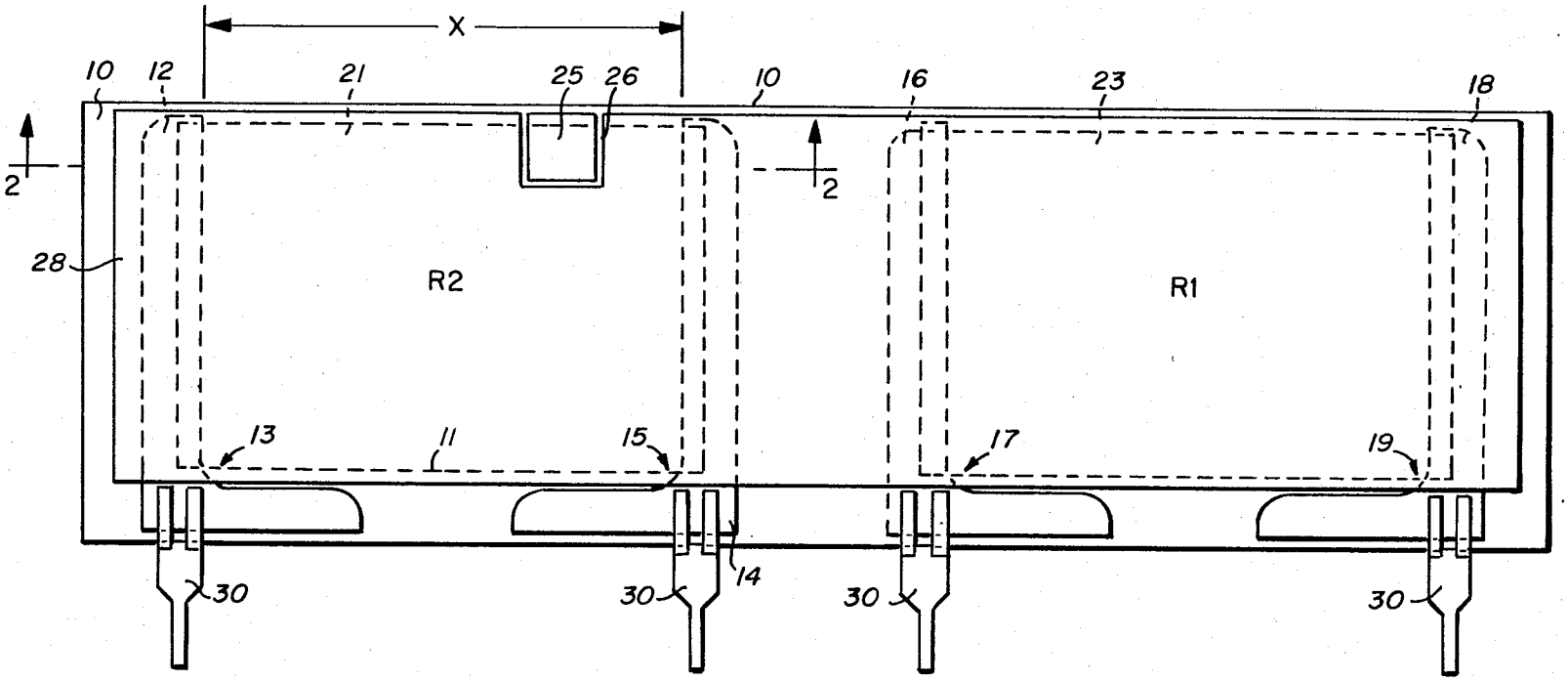
FIG. 1 is a top view of a thick film resistor fabricated according to this invention.

FIG. 1 is a top view of the preferred embodiment of a high voltage thick film resistor. As shown in FIG. 1 the resistor includes a ceramic substrate 10 approximately 2 inches by 0.6 inches on which two resistors R1 and R2 are to be fabricated. Ceramic substrates such as substrate 10 are commercially available, for example from Coors Company, Golden, Colo. Obviously, a single resistor could be fabricated on the ceramic substrate, or more than two resistors fabricated, if desired. The particular application for the structure shown in the Figures is to provide voltage spike protection for surges up to a thousand volts. Using well-known screen printing technology and suitable electrically conductive material, a conductive pattern comprising regions 12, 14, 16, 18, and any desired pattern on the opposite surface (not shown) of substrate 10 are deposited using conventional techniques. In the preferred embodiment the metal pattern 12, 14, etc. is approximately 0.5 mils thick and comprises palladium-silver in glass paste, available from Electro-Science Laboratories, Pennsauken, N.J. Of particular advantage is the rounding of corners 13, 15, 17, and 19 of the metal patterns 12, 14, 16, and 18, respectively. These rounded corners slightly reduce the separation distance X along line 11 of R2 between electrodes 12 and 14 nearer the lower edge of the substrate 10, as shown in FIG. 1. Similarly, the rounded corners 17 and 19 slightly reduce the separation between electrodes 16 and 18 at the same edge.

Next, using well-known silk screen technology two regions of thick film resistive material 21 and 23 are coated onto substrate 10 to overlap electrodes 12, 14, 16, and 18 in the manner shown. In the preferred embodiment the resistive material comprises ruthenium oxide, and is commercially available from DuPont as product 1721, or from other commercial sources. I have found that by coating resistive material 21 and 23 onto the substrate through a 325 mesh silk screen to an average dry thickness of 0.7 mils at less than one inch per second print speed, a very consistent resistor print is achieved making the volume resistivity at point locations throughout the resistor much more equal than in conventional resistors. Trimming the resistor is also facilitated, as a lower power laser beam is required, thereby lessening microcracking around the trim kerf 26.

After fabrication of the resistive areas 21 and 23, the substrate is passivated by being coated with glass such as DuPont product 9127. The glass coating 28, is shown in FIG. 1, and is shown in cross section in FIG. 2. As shown in the Figures, the resistor size is made as large as possible as limited by the size of the substrate to minimize electric field density. At any desired time in the process, suitable well-known electrical connections such as connections 30 may be provided to desired ones of the electrically conductive regions 12, 14, 16, and 18. Only two terminals 30 are shown, however, as is well-known several terminals may be used to connect to each conductive region.

At the completion of manufacture, the resistive elements may be tested and their resistances adjusted by suitable laser trimming operations. For the embodiment depicted in FIG. 1, resistance R2 has been trimmed to match resistance R1 by electrically disconnecting a portion 25 of resistive material 21 from the remaining resistive material. This is achieved in the preferred embodiment by using a laser to cut a kerf 26 through the passivating material 28 and the underlying resistive material 21. This cut is shown in cross sectional in FIG. 2. Of particular advantage to the resistor is the fact that the electric field in the vicinity of this kerf is minimized by increasing the surface area of the facing resistor walls. This is achieved by the passivating material 28 deposited on the upper surface of the resistive material 21. In addition, the passivating material helps maintain uniform heat distribution throughout the resistor, therefore minimizing the occurrence of hot spots.

The trimming of the resistor is done along the edge of the resistive material away from the terminations so as not to trim through the region of highest electric field density created by the reduced width X in the vicinity of the curved corners 13 and 15. As straight a kerf pattern as possible is formed in order to make the electric field as uniform as possible, thereby minimizing arcing and the formation of microcracks. Alternatively, if desired, the upper end of the conductive lines 12 and 14 may be curved to bring these regions closer together, and the trimming operation done along the lower edge 11 of the resistive material.

Figure 2:
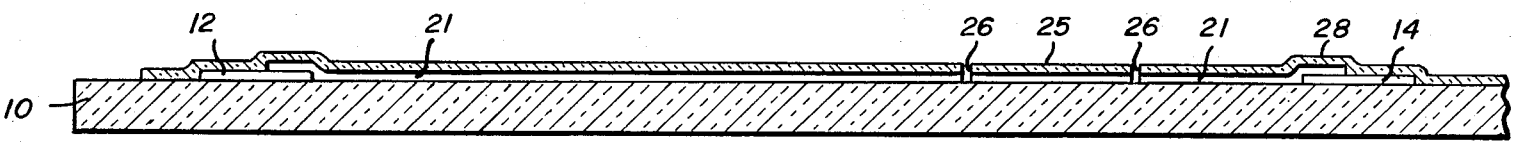
FIG. 2 is a cross sectional view of the structure shown in FIG. 1.

FIG. 2 is a cross sectional view of the structure shown in FIG. 1 illustrating the arrangement of the conductive regions 12 and 14, the substrate 10, resistive material 21 and passivating material 28.

Additional information concerning my high voltage thick film resistor is described in my paper entitled "Product Review Resistor Network," published at pages 534–538 in the June, 1982 proceedings of the International Society of Hybrid Microelectronics.

Although the foregoing invention has been described with respect to a particular embodiment, this embodiment is not intended to limit the invention, but rather to clarify and explain it. The scope of my invention is to be determined from the appended claims.

I claim:

1. A thick film trimmable high voltage spike resistant resistor comprising:

an insulating substrate;

a pair of spaced apart electrical connections affixed to the substrate;

a region of electrically resistive material coated on the substrate and not in physical contact with either of the pair of spaced apart electrical connections, the region of electrically resistive material being adapted to be trimmed along an edge to thereby increase its resistance;

a pair of spaced apart strips of electrically conductive material on the substrate each in physical and electrical contact with the region of electrically resistive material and extending to a respective one of the pair of spaced apart electrical connections, the strips being substantially parallel where in contact with the resistive material except at the ends of the strips opposite the edge adapted to be trimmed where the strips are closer together, thereby placing the highest electric field away from the edge adapted to be trimmed whereby the electric field effect of a high voltage spike is minimized.

2. A resistor as in claim 1 further comprising a coating of passivating material disposed over the region of resistive material and the pair of spaced apart strips.

3. A thick film resistor as in claim 2 wherein the resistive material comprises ruthenium oxide.

4. A resistor as in claim 3 wherein the electrically conductive material comprises palladium-silver.

5. A thick film trimmable high voltage spike resistant resistor comprising:

a ceramic substrate;

a pair of spaced apart conductive regions affixed to the substrate;

a region of electrically resistive material coated on the ceramic and not in physical contact with either of the pair of spaced apart electrical connections, the region of electrically resistive material being adapted to be trimmed along an edge opposite the pair of spaced apart electrical connections to thereby increase the resistance of the resistor;

a pair of spaced apart strips of electrically conductive material on the ceramic substrate each in physical and electrical contact with the region of electrically resistive material and extending to a respective one of the pair of spaced apart electrical connections, the strips being substantially parallel where in contact with the resistive material except at the ends of the strips opposite the edge adapted to be trimmed where the strips are closer together, thereby placing the highest electric field away from the edge adapted to be trimmed, whereby the electric field effect of a high voltage spike is minimized.

6. A thick film trimmable high voltage spike resistant resistor including:

a pair of spaced apart electrical connections affixed to the substrate;

a region of electrically resistive material coated on the substrate and not in physical contact with either of the pair of spaced apart electrical connections, the region of electrically resistive material being adapted to be trimmed along an edge to thereby increase its resistance;

a pair of spaced apart strips of electrically conductive material on the substrate each in physical and electrical contact with the region of electrically resistive material and extending to a respective one of the pair of spaced apart electrical connections, wherein the improvement comprises the strips being substantially parallel where in contact with the resistive material except at the ends of the strips opposite the edge adapted to be trimmed where the strips are closer together, thereby placing the highest electric field away from the edge adapted to be trimmed.

* * * * *